US005143303A

United States Patent [19]

Niemi

[11] Patent Number: 5,143,303

[45] Date of Patent: Sep. 1, 1992

[54] METHOD AND EQUIPMENT FOR PROCESSING OF PARTICULARLY FINELY DIVIDED MATERIAL

[75] Inventor: Jouko Niemi, Pirkkala, Finland

[73] Assignee: Oy Finnpulva AB, Pirkkala, Finland

[21] Appl. No.: 689,852

[22] Filed: May 23, 1991

[30] Foreign Application Priority Data

Nov. 28, 1988 [FI] Finland ..... 885525

[51] Int. Cl.[5] ..... B02C 19/06

[52] U.S. Cl. ..... 241/5; 241/39; 241/79.1

[58] Field of Search ..... 241/5, 19, 39, 79.1, 241/80

[56] References Cited

U.S. PATENT DOCUMENTS

| | | | |
|---|---|---|---|
| 4,235,665 | 11/1980 | Reinhall et al. | 241/79.1 X |
| 4,304,360 | 12/1981 | Luhr et al. | 241/79.1 X |
| 4,586,661 | 5/1986 | Niemi | 241/39 X |
| 4,811,907 | 3/1989 | Niemi | 241/5 |

*Primary Examiner*—Douglas D. Watts
*Attorney, Agent, or Firm*—McGlew & Tuttle

[57] ABSTRACT

A method and a equipment for processing of particularly finely divided material. The material is fed by means of a mechanical feeder device (2) and a pressurized equalization tank (4) into a fluidization chamber (5). A fluidized gas-solids suspension received is accelerated through acceleration nozzles (20) into a grinding chamber of a counter-jet grinder (19) so as to grind the solid particles. The ground gas-solids suspension is passed through connecting pipe (7) into a centrifugal classifier (8). A fine fraction is removed as a gas suspension through an opening (9). Additional air of low pressure is passed into the connecting pipe (7) and the coarse fraction is removed from the centrifugal classifier through a removal opening (10) in the peripheral face of the classifier into a pocket (12) outside said peripheral face, whereby the coarse fraction in the pocket (12) is removed batchwise by means of a closing device (13).

13 Claims, 2 Drawing Sheets

METHOD AND EQUIPMENT FOR PROCESSING OF PARTICULARLY FINELY DIVIDED MATERIAL

FIELD OF THE INVENTION

The present invention concerns a method and an equipment for processing of particularly finely divided material, wherein the material is fed by means of a mechanical feeder device into a pressurized equalization tank, out of the equalization tank the material is fed by means of a screw conveyor as a uniform flow into a fluidization chamber, wherein process gas is fed to among the material particles to produce a gas-solids suspension, and the gas-solids suspension produced is accelerated, by means of the positive pressure prevailing in the fluidization chamber, through a bifurcation device and through acceleration nozzles of a counter-jet grinder, connected to the branch pipes of said bifurcation device, into the grinding chamber in the counter-jet grinder so as to grind the solid particles, and the ground gas-solids suspension produced in the grinding chamber is passed, by the effect of the after-pressure of the grinding chamber, through a connecting pipe into a centrifugal classifier, from which the fine fraction is removed, being carried by the gas employed in the process, through a substantially axial opening for the removal of the fine fraction.

BACKGROUND OF THE INVENTION

When a particularly finely divided, especially jet-ground material is processed in classifiers based on centrifugal force, it is necessary to aim at a very high inlet velocity as well as at such a gas-solids suspension in which the excess quantity of gas is very large. When the difference in size between the solid particles to be classified is reduced, the difficulties in obtaining a satisfactory result of classification are increased very steeply. This comes from the fact that, when the particle size is very little, for example 1 μm and less, the differences in conduct obtainable by means of centrifugal force between the particles of different sizes are extremely little, which imposes very high requirements on the classifier In the prior-art embodiments wherein the gas-solids suspension rushing out of the jet grinder is passed directly into the classification chamber, the solids content in the gas-solids suspension is relatively high. In order that a good grinding capacity and economy could be obtained, it is, namely, required that the solids contents in the gas-solids jets rushing into the grinding chamber are kept at a relatively high level, in order that the probability of collision of the solid particles should be sufficiently high and that the consumption of "expensive" high-pressure air should remain within reasonable limits. In order that a good result of classification could be obtained, therefore, attempts have been made to introduce additional air into the classification chamber, e.g., through tangentially directed additional-air nozzles. In practice, it has, however, been noticed that these additional-air jets cause flow phenomena that disturb the process of classification, so that, with the prior-art equipments it has proved extremely difficult to obtain a satisfactory result of classification in respect of ultrafine material.

The difficulties in classification of ultra-fine solid material come out clearly-from an experiment of classification and grinding, which has been carried out in practice, which is examined from the point of view of calculation, and wherein it has been studied how the velocities of particles of different sizes (density =2750 g/cm$^3$) are changed as a function of the distance of the particle concerned after the acceleration nozzle that accelerates the gas-solids suspension. The following table gives the theoretical values for the deceleration of particles of different sizes after the nozzle from the initial velocity $v_{po}$ as the distance becomes longer. The table also clearly indicates the significance of the feed-in velocity of the particles for classification and grinding.

| Particle size μm | Theoretical deceleration at a distance of 1 cm m/s | 3 cm m/s | 5 cm m/s | 10 cm m/s |
|---|---|---|---|---|
| 1 | decelerated immediately to the velocity of the gas effective in the space | | | |
| 5 | 60 | 180 | decelerated to the velocity of the gas effective in the space | |
| 10 | 15 | 45 | 75 | 150 |
| 20 | 5 | 10 | 20 | 40 |
| 50 | 1 | 2 | 3 | 6 |

From the table it comes out that particles of a size of 1 and 5 μm are almost immediately adapted to the velocity of the gas effective in the space, so that separation of particles of 5 μm from a gas-solids suspension is very difficult and requires a classification chamber of relatively small diameter.

SUMMARY AND OBJECTS OF THE INVENTION

Coarse fraction is very often removed from classifiers as a continuous gas-solids suspension flow, whereby a considerable amount of fine material is also removed from the classifier along with the coarse fraction. The fine fraction that follows along with the coarse fraction must then be separated from the coarse fraction, e.g., in a separate cyclone or returned with the coarse fraction into the feeder of the jet grinder, which operations restrict the operation and the capacity of the whole equipment unnecessarily.

The object of the present invention is to eliminate the above drawbacks, which is accomplished by means of a method which is characterized in that additional air of low pressure is passed into the connecting pipe so as to lower the solids content in the gas-solids suspension, and the coarse fraction is removed from the centrifugal classifier through a removal opening placed in the peripheral face of the classifier into a pocket placed outside the peripheral face, and the coarse fraction gathered in the pocket is removed batchwise to normal atmospheric pressure through a closing device placed in the bottom of the pocket.

The other characteristics of the invention come out from the accompanying patent claims.

BRIEF DESCRIPTION OF THE DRAWINGS

In the following, the invention will be described in more detail with reference to the accompanying drawing, wherein.

DETAILED DESCRIPTION OF THE PREFERRED EMBODIMENTS

Figure 1:
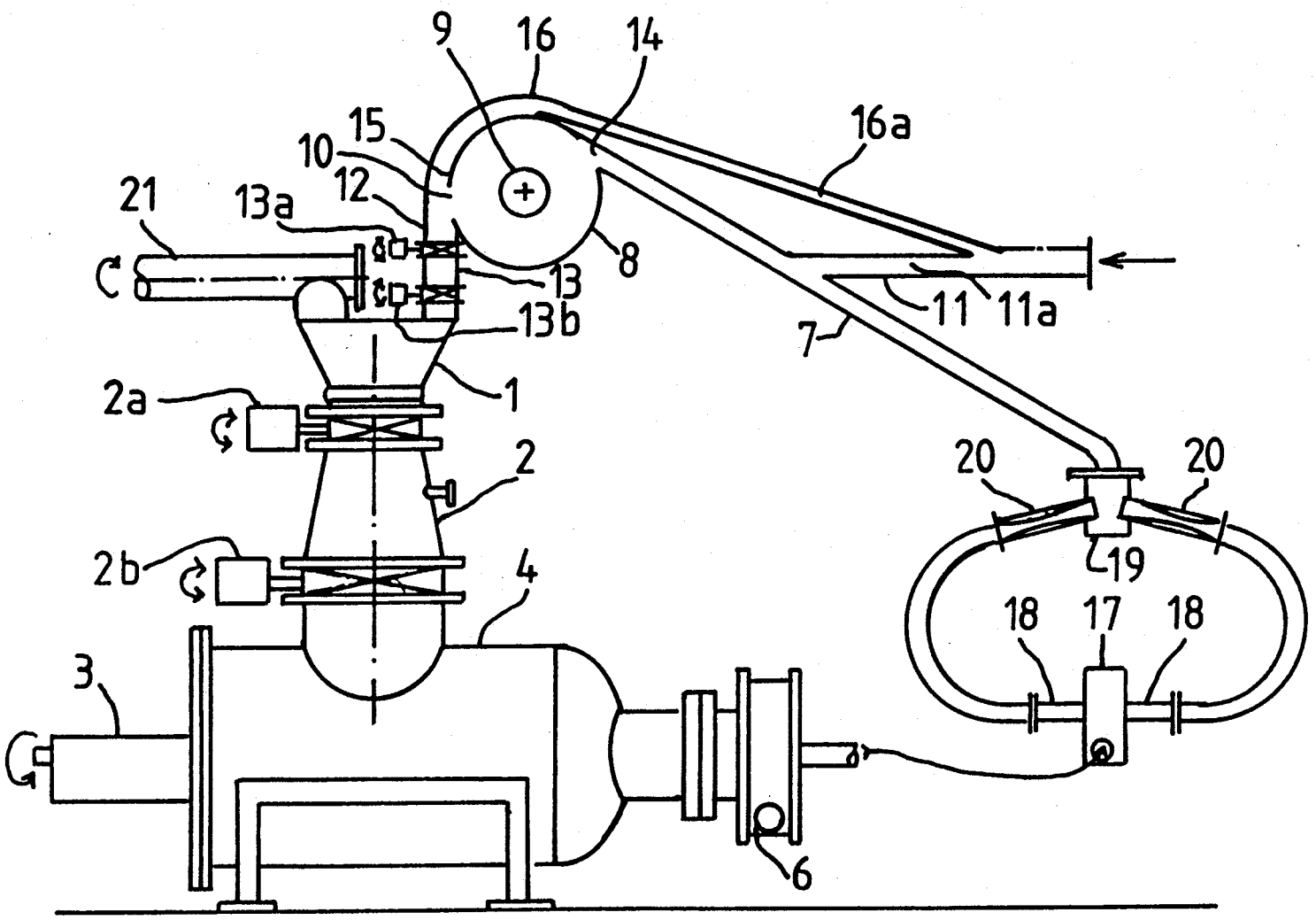
FIG. 1 is a schematical illustration of an exemplifying embodiment of a processing equipment in accordance with the invention.

In its basic embodiment, the equipment in accordance with the invention comprises a mechanical feeder device provided with a feed funnel 1, such as a dual-valve feeder 2, a pressurized equalization tank 4, which is provided with a screw conveyor 3 and which is jointly operative with the feeder 2, an advantageously cylindrical fluidization chamber 5 mounted at the outlet end of the screw feeder, into which chamber process gas is fed through a tangential inlet pipe 6, a bifurcation device 17 connected to the outlet opening of the fluidization chamber 5, and acceleration nozzles 20, which are connected to the branch pipes 18 of the bifurcation device and which terminate in the grinding chamber of a counter-jet grinder 19, as well as a substantially cylindrical classifier 8, which is connected to the outlet opening of the counter-jet grinder 19 by the intermediate of a connecting pipe 7, said connecting pipe 7 terminating in said classifier 8 tangentially, and said classifier 8 being provided with a substantially axial opening 9 for the removal of the fine fraction. The inlet pipe 11 for additional air is connected to the connecting pipe 7 at a sharp angle, and in the peripheral face of the narrow centrifugal classifier 8 there is an opening 10 for the removal of the coarse fraction, said opening passing into a pocket 12 placed outside the peripheral face, a closing member 13 being placed in the bottom of said pocket.

Fresh material is fed into the feed funnel 1 of the equipment by means of a screw feeder 21. From the feed funnel 1 the material to be processed falls into the tank of the dual-valve feeder 2 when the upper valve **2*a* is open and when the lower valve 2*b* is closed. After the tank in the feeder 2 has been filled up to a certain level or, alternatively, after a certain time interval, the upper valve 2*a* is closed automatically, and the tank of the feeder is pressurized to the desired level by means of process gas. After the pressure has reached the desired level, the supply of gas is switched off and the lower valve 2*b* in the feeder is opened, whereby the batch contained in the tank of the feeder 2 falls down into the equalization tank 4, wherein a substantially equally high invariable pressure is maintained. Immediately hereupon the valve 2*b* is closed and the pressure in the feeder 2 tank is lowered to the normal pressure, whereupon the upper valve 2*a* is opened for a new batch. The material to be processed which was fed into the equalization tank 4 is transferred in a loose state by means of the screw conveyor 3 as a uniform flow into the fluidization chamber 5, where the material is fluidized by means of the process gas supplied through the pipe 6. As the process gas, advantageously compressed air at a pressure of about 4 to 10 bars is used. The relatively dense gas-solids suspension generated in the fluidization chamber 5 is divided in the bifurcation device 17 into two equivalent component flows, which rush out of the branch pipes 18 of the bifurcation device 17 into the acceleration nozzles 20 of the counter-jet grinder 19, in which nozzles they are, by the effect of the high pressure prevailing in the fluidization chamber, accelerated to a supersonic velocity. The gas-solids jets that rush out of the acceleration nozzles 20, which are directed almost one against the other, collide against each other in the middle part of the grinding chamber in the counter-jet grinder 19, whereby the solid particles are ground efficiently. The gas-solids suspension ground in the grinding chamber rushes through the connecting pipe 7 tangentially into the centrifugal classifier 8. In order to bring the solids content in the gas-solids suspension rushing into the centrifugal classifier to a level optimal in view of the classification, low-pressure additional air is supplied concurrently into the gas-solids suspension through the inlet pipe 11, which terminates in the connecting pipe 7 at a sharp angle. In FIG. 1 the bifurcation device 17 and the counter-jet grinder 19** have been turned by 90° around the vertical axis in view of better clarity of illustration.

The classification of the gas-solids suspension rushing into the classifier 8 tangentially takes place by means of centrifugal force. The velocity of the finest particles is lowered almost immediately to the velocity of the gas circulating in the classifier 8, and said particles are removed along with the gas through the axial opening 9 for the removal of the fine fraction. On the contrary, the coarser particles retain their velocity to such an extent longer that they move along the peripheral face of the classifier 8 and rush out of the classifier 8 through the opening 10 for the removal of the coarse fraction, which is placed in the peripheral face of the classifier, being gathered in the pocket 12 placed outside the peripheral face. The coarse fraction gathered in the pocket 12 is removed to the normal atmospheric pressure batchwise through the closing device 13 placed in the bottom of the pocket 12. Since the coarse fraction is not removed out of the pocket 12 as a continuous gas-solids flow, but as periodic solid batches, the finely divided particles do not attempt to escape out of the classifier 8 through the opening 10 for the removal of the coarse fraction.

In the solution in accordance with FIG. 1, the closing device 13 consists of a dual-valve device. The valves **13*a* and 13*b* in this dual-valve device 13 are advantageously programmed so that they are alternatingly opened and closed at an adjustable frequency. First the upper valve 13*a* is opened and remains open for a while so that the tank in the dual-valve device 13 is filled up to a certain level, at which time the valve 13*a* is closed, and immediately thereupon the lower valve 13*b* is opened, whereby the batch of coarse fraction that was fed into the tank in the dual-valve device 13 rushes out, e.g., into a tank for coarse product or is returned into the feed funnel 1 of the equipment. By the effect of the centrifugal force, a slight positive pressure is developed in the tank of the dual-valve device 13 every time when the valve 13*a* is open. This positive pressure promotes the removal of the batch of coarse fraction from the tank in the dual-valve device 13 upon opening of the valve 13*b*. After the tank in the dual-valve device 13 has been emptied, the valve 13*b* is closed again, and the valve 13*a* is opened for a new batch. The operations of the valves 13*a* and 13*b* in the dual-valve device 13** are preferably programmed so that they are opened and closed alternatingly at an adjustable frequency. The frequency is determined, e.g., in accordance with the material to be processed and with the capacity of the equipment.

Figure 2:
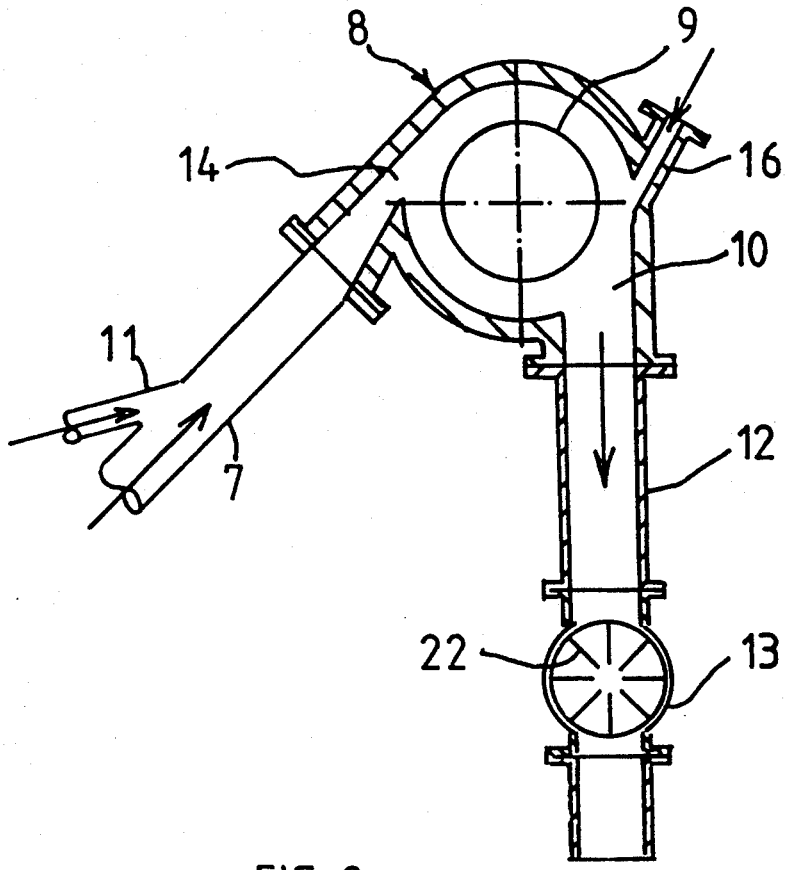
FIG. 2 shows a second exemplifying embodiment of the classifier part in an equipment in accordance with the invention.
Figure 3:
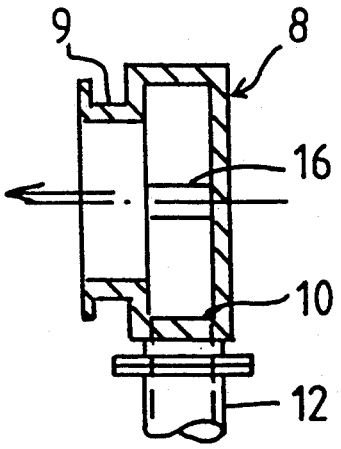
FIG. 3 is a sectional view taken along the line A—A in FIG. 2.
Figure 4:
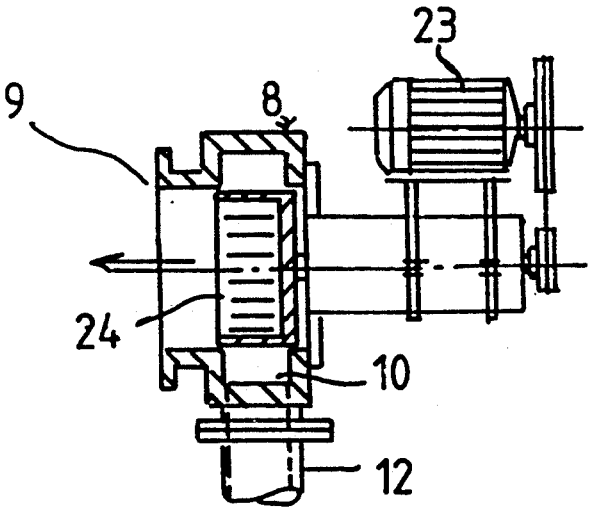
FIG. 4 is an axial sectional view of an alternative embodiment of the classifier.

In the classifier solution shown in FIG. 2, which has been turned as a mirror image in relation to the device shown in FIG. 1, the closing device 13 consists of a compartment feeder, in which the speed of rotation of its compartment wheel 22 is adjusted in accordance with the material to be processed and with the capacity of the equipment. The costs of operation and acquisition of a compartment feeder 13 are considerably lower than those of a dual-valve device.

The efficiency of the classifier can be improved further by forming the mantle face of the classifier 8 between the inlet opening 14 for the material-gas suspension and the opening 10 for the removal of the coarse fraction as an adjustable guide wing 15, by whose means the movement of circulation of the material-gas flow taking place in the classifier can be controlled and shaped as desired. The prevention of escaping of the fine fraction through the opening 10 for the removal of the coarse fraction can be intensified further by outside the guide wing 15 providing an expanding wedge-shaped acceleration passage 16 for low-pressure flushing air, said passage terminating at the level of the opening 10 for the removal of the coarse fraction, in order that a flow geometry favourable in view of the flushing could be obtained. The flushing air is supposed to flow through the removal opening 10 into the classifier 8 and, at the same time, to "flush" the particles of coarse fraction that are being removed through the removal opening 10, whereby any particles of fine fraction that may follow along with said coarse particles are passed, along with the flushing air, into the opening 9 for the removal of the fine fraction. The flushing air also contributes to the maintaining of the rapid movement of circulation, required by the centrifuqal force, in the classifier 8.

The best result is obtained if the acceleration passage 16 is shaped as curved, whereby the emphasis of the flushing air is shifted to the vicinity of the outer circumference. In such a case, flow phenomena that interfere with the classification process are reduced decisively, because the jet of flushing air is passed as a narrow layer along the mantle face of the classification chamber.

In front of the opening 9 for the removal of the fine fraction, it is advantageously possible to arrange, e.g., a rotor 24 operated by an electric motor 23, whose movement of rotation prevents the access of coarser particles into the opening 9 for the removal of the fine fraction efficiently. The optimal speed of rotation depends on the material that is processed. The rotor 24 extends in the axial direction substantially across the entire width of the classification chamber. Since the kinetic energy of the gas-solids flow rushing through the connecting pipe 7 tangentially into the classifier 8 can be utilized as drive energy of the rotor 24, which gives the rotor 24 a considerable initial speed, thus, a power source 23 of considerably lower output is adequate than in the prior-art rotor solutions.

The additional air fed into the connecting pipe 7 and the flushing air fed into the classifier 8 through the opening 10 for the removal of the coarse fraction can be taken favourably out of a common source of low-pressure gas. In such a case, it is preferable that the inlet pipe 11 for additional air and the inlet duct 16 for flushing air are provided with regulation valves **11*a* and 16*a*** in order to achieve a correct quantitative ratio between these air supplies.

What is claimed is:

1. A method for processing of particularly finely divided material, the method comprising:

feeding the material, by means of a mechanical feeder device, into a pressurized equalization tank; feeding the material out of the equalization tank, by means of a screw conveyor, as a uniform flow into a fluidization chamber; mixing process gas with the uniform flow to produce a gas-solid suspension; accelerating the gas-solid suspension, by means of positive pressure prevailing in the fluidization chamber, through a bifurcation device, and through acceleration nozzles of a counter-jet-grinder grinding chamber, the counter-jet-grinder grinding chamber being connected to branch pipes of the bifurcation device, to grind solid particles to form a ground gas-solid suspension; passing the ground gas-solid suspension, produced in the grinding chamber, by an effect of an after-pressure of the grinding chamber, through a connection pipe into a centrifugal classifier; removing a fine fraction of the ground gas-solid suspension, the fine fraction being carried by a gas through a substantially axial opening; passing additional air, of lower pressure, into the connection pipe so as to lower the solids content in the gas-solid suspension for removing a coarse fraction of the ground gas-solid suspension from the centrifugal classifier through a removal opening in a peripheral face of the classifier into a pocket positioned outside the peripheral face; and removing the course fraction gathered in the pocket batchwise to normal atmospheric pressure through a closing device placed in a bottom of the pocket.

2. A method according to claim 1, wherein flushing air of low pressure is fed in the centrifugal classifier tangentially concurrently through the removal opening for the removal of the coarse fraction placed in the peripheral face of the centrifugal classifier.

3. A method according to claim 2, wherein the coarse fraction removed by means of the closing device batchwise is returned into the mechanical feeder device.

4. A method according to claim 3, wherein compressed air at a pressure of 4 to 10 bars is fed into the fluidization chamber.

5. A device for processing particularly finely divided material, comprising a mechanical feeder device including a feed funnel; an equalization tank provided with a screw conveyor, said equalization tank being fitted underneath said mechanical feeder device, connected to said mechanical device feeder; a cylindrical fluidization chamber mounted at an outlet of said screw feeder; a process-gas feed pipe tangentially connected to said cylindrical fluidization chamber; a bifurcation device connected to an outlet opening of said fluidization chamber; branch pipes connected to said bifurcation device; acceleration nozzles connected to each of said branch pipes, said nozzles terminating in a grinding chamber of a counter-jet grinder; an intermediate connection pipe connected to said counter-jet grinder; a substantially cylindrical centrifugal classifier connected to said connection pipe, said connecting pipe terminating in said cylindrical centrifugal classifier tangentially, said classifier including a substantially axial opening for the removal of a fine fraction of the ground material; an additional air inlet pipe connected to said connection pipe at a low angle, said centrifugal classifier including a peripheral face with an opening for the removal of a coarse fraction of the ground material, said opening passing into a pocket positioned outside the peripheral face; and a closing member positioned in the bottom of said pocket.

6. A device according to claim 5, wherein said cylindrical centrifugal classifier includes an area between an inlet opening for gas-solid suspension from said connecting pipe and said opening for removal of the coarse fraction, said area including a mantle face formed as an adjustable guide wing, expanding wedge-shaped acceleration passage for flushing air, said acceleration passage terminating at said opening for the removal of the coarse fraction, and being provided at an outer side of said guide wing.

7. A device according to claim 6, wherein said acceleration passage is curved.

8. A device according to claim 6, wherein a rotor is fitted in said opening for the removal of the fine fraction.

9. A device according to claim 8, wherein said closing device is a dual-valve device, including valves programmed to open alternatingly at an adjustable frequency.

10. A device according to claim 8, wherein said closing device is a compartment feeder.

11. A device according to claim 9, wherein said closing device communicates with said feed funnel for feeding the coarse fraction to each said mechanical feeder device.

12. A device according to claim 11, wherein said additional air inlet pipe and said acceleration passage for flushing air are drawn from a common source of low-pressure gas.

13. A device according to claim 11, wherein said additional air inlet pipe and said acceleration passage for flushing air are provided with regulation valves.

* * * * *